United States Patent [19]

Nitta et al.

[11] 4,209,672

[45] Jun. 24, 1980

[54] METHOD AND APPARATUS FOR MEASURING CHARACTERISTICS OF A LOUDSPEAKER

[75] Inventors: Tsuneo Nitta, Yokohama; Masatoshi Tanaka, Koganei, both of Japan

[73] Assignee: Tokyo Shibaura Denki Kabushiki Kaisha, Kawasaki, Japan

[21] Appl. No.: 924,357

[22] Filed: Jul. 13, 1978

[30] Foreign Application Priority Data

Jul. 15, 1977 [JP] Japan ..... 52-84133
Jul. 15, 1977 [JP] Japan ..... 52-84134

[51] Int. Cl.[2] ..... H04R 29/00
[52] U.S. Cl. ..... 179/175.1 A
[58] Field of Search ..... 179/175.1 A, 175.1 R, 179/175, 1 MN, 1 N, 1 D, 1 G, 1 GP, 1 P, 1 SA

[56] References Cited

U.S. PATENT DOCUMENTS 3,912,880 10/1975 Powter et al. ..... 179/175.1 A
4,066,842 1/1978 Allen ..... 179/1 SA

OTHER PUBLICATIONS

Oppenheim et al., "Homomorphic Analysis of Speech," IEEE Trans. Audio Electroacoust., vol. Au-16, No. 2, Jun. 1968, pp. 221-226.

*Primary Examiner*—Thomas A. Robinson
*Attorney, Agent, or Firm*—Oblon, Fisher, Spivak, McClelland & Maier

[57] ABSTRACT

A loudspeaker and a microphone are arranged in a normal room, the loudspeaker being supplied with an impulse signal. A direct response sound from the loudspeaker and reflected sounds from wall surfaces in three directions of the normal room are converted into a response signal by the microphone. The response signal is A/D-converted, and then Fourier-transformed. The Fourier-transformed response signal is converted into a response signal with an absolute value, and then into a logarithmic response signal. The logarithmic response signal is filtered to eliminate signal components corresponding to the reflected sound. The filtered logarithmic response signal is A/D-converted, and supplied to a recorder.

6 Claims, 11 Drawing Figures

METHOD AND APPARATUS FOR MEASURING CHARACTERISTICS OF A LOUDSPEAKER

This invention relates to a method and an apparatus for measuring characteristics of a loudspeaker.

Measurements of the characteristics of a loudspeaker or a loudspeaker system with a loudspeaker mounted in an enclosure are generally conducted in an anechoic room, which is constructed acoustically to isolate the loudspeaker to be measured from the outside and to absorb any internal sounds. Such an anechoic room, however, requires large-scale equipment which may prove to be expensive.

The object of this invention is to provide a method and an apparatus for measuring characteristics of a loudspeaker, which enables a satisfactory measurement of the loudspeaker characteristics in a normal room without requiring an anechoic room.

According to this invention, the loudspeaker is driven by an impulse signal, and a direct impulse response sound from the loudspeaker and sounds reflected from a plurality of positions are converted into an impulse response signal. This impulse response signal is converted into a digital response signal by an A/D converter, and then Fourier-transformed. The Fourier-transformed response signal is converted into a response signal with an absolute value, and further logarithmically converted by means of a logarithm converter. The resultant logarithm response signal is passed through a filter circuit to filter out signal components corresponding to the reflected sound. The filtered response signal is D/A-converted, and then supplied to an output unit.

This invention can be more fully understood from the following detailed description when taken in conjunction with the accompanying drawings, in which.

Figure 1:
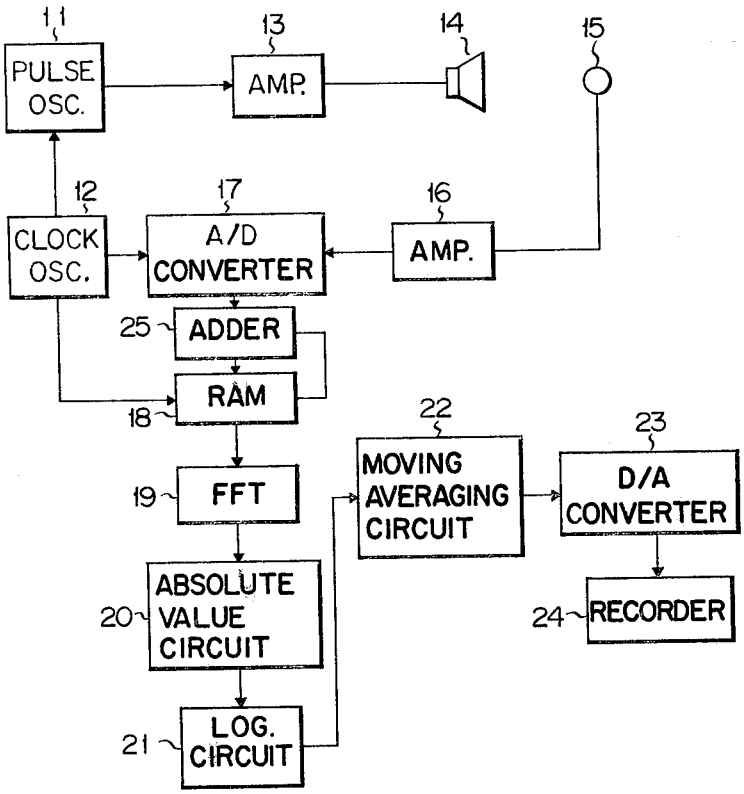
FIG. 1 is a block diagram of a loudspeaker characteristics measuring apparatus according to an embodiment of this invention.
Figure 2:
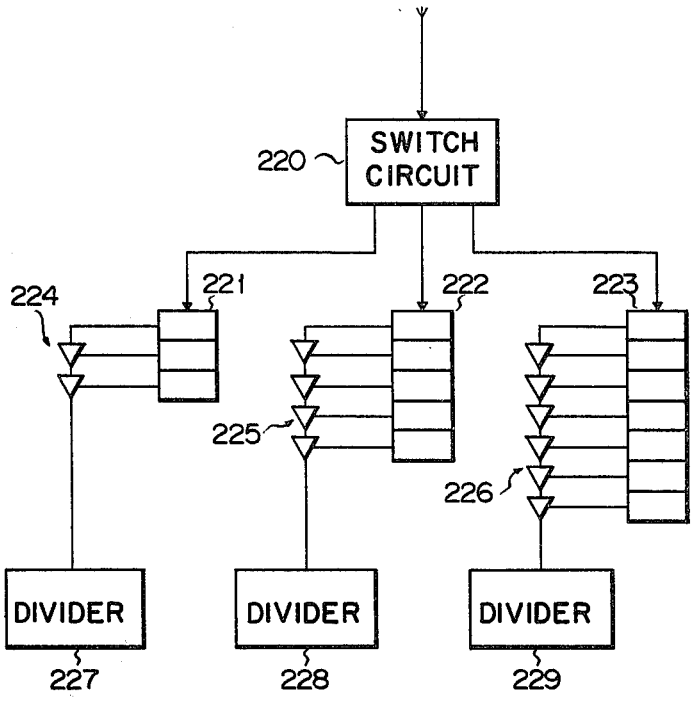
FIG. 2 is a circuit diagram of a moving averaging device used with the apparatus of FIG. 1.

In a circuit as shown in FIG. 1, a pulse oscillator 11 generates impulse signals synchronously with clock pulses from a clock pulse oscillator 12. The output of the pulse oscillator 11 is supplied to a loudspeaker 14 through an amplifier 13. A microphone 15 is disposed at a distance of approximately 50 cm from the loudspeaker 14. The output terminal of the microphone 15 is coupled to an A/D converter 17 through an amplifier 16. The A/D converter 17 has an input terminal coupled with the output terminal of the clock pulse oscillator 12 and through an adder 25, the output terminal of the A/D converter 17 is coupled to a random access memory (RAM) 18. The random access memory 18 has a synchronizing signal input terminal coupled with the output terminal of the clock pulse oscillator 12. Further the random access memory 18 has a first output terminal which is coupled with its input terminal connected with the output terminal of the A/D converter 17, and a second output terminal connected to the input terminal of a fast Fourier-transform (FFT) processor 19. The output terminal of the fast Fourier-transform processor 19 is coupled to a logarithm circuit 21 through an absolute value circuit 20. The output terminal of the logarithm circuit 21 is coupled to a moving averaging circuit 22. The moving averaging circuit 22 is constructed as shown in FIG. 2, including a switch circuit 220 connected with the output terminal of the logarithm circuit 21. The switch circuit 220 is so designed as to perform switching operations in response to signals in the low, middle, and high frequency bands. L-, M- and H-output terminals of the switch circuit 220 are connected to the input terminals of shift registers 221, 222 and 223, respectively. These shift registers 221, 222 and 223, for example, are of 3-, 5- and 7-stage configurations, respectively. The output terminals of the first and second stages of the shift register 221 are coupled to the first-stage adder of a 2-stage adder circuit 224, while the third or final stage of the shift register 221 is coupled to the second-stage adder. Likewise the first and second stages of the shift register 222 are coupled to the first-stage adder of a 5-stage adder circuit 225, while the third to fifth stages are coupled to the second to fourth adders, respectively. Furthermore, seven stages of the shift register 223 are coupled to a 6-stage adder circuit 226 in like manner. The respective final-stage adders of the adder circuits 224, 225 and 226 are coupled to 1/L, 1/M and 1/N dividers 227, 228 and 229, respectively. The output terminals of these dividers 227, 228 and 229, are connected to a D/A converter 23, the output terminal of which is coupled to an output unit, such as an X-Y recorder or oscilloscope.

In the loudspeaker characteristics measuring apparatus with the aforementioned construction, when the pulse oscillator 11 generates an impulse synchronously with a clock pulse generated by the clock pulse oscillator 12, the impulse is amplified to a predetermined level by the amplifier 13, and then supplied to the loudspeaker 14. Supplied with the impulse, the loudspeaker 14 produces an impulse response sound. The impulse response sound is converted into a response signal by the microphone 15. Where the microphone 15 and the speaker 14 are disposed in a substantially central position of a normal room, the microphone 15 receives the direct response sound from the loudspeaker 14 and sounds reflected by wall surfaces in at least three different directions, i.e. ceiling and floor, right and left side walls and forward and backward walls, of the normal room (not shown) in which the loudspeaker and microphone are set. Then the microphone 15 converts the direct response sound and the reflected sounds into an electric signal. The electric signal or response signal from the microphone 15 is amplified by the amplifier 16, and then converted into a digital response signal by the A/D converter 17 synchronously with the clock pulse from the clock pulse oscillator 12. The digital response signal is stored in the random access memory 18. The stored digital response signal is read out from the memory 18 synchronously with the clock pulse, and then written again in the memory 18 through an adder 25. A full cycle of such reading-addition-writing processes is repeated several times, thereby raising the level of effective signal components of the digital response signal i.e. improving the S/N ratio. The response signal, with the effective signal components raised to a prescribed level, is read out from the memory 18, and supplied to the fast Fourier-transform processor 19 for Fourier transformation. The fast Fourier-transform processor 19 used may be a Model AP-120B array processor from FLOATING POINT SYSTEMS, INC., Switzerland, for example. The response signal or frequency spectrum signal processed by such fast Fourier-transform processor 19 is converted into an absolute-value signal by the absolute value circuit 20, and then made logarithmic, that is, converted into a decibel signal by the logarithm circuit 21. This decibel signal is filtered by the moving averaging circuit 22. In such filtering, signals in a frequency range (band) below 80 Hz are supplied to the shift register 221; those in a range (band) from 80 Hz to 122 Hz to the shift register 222, and those in a range (band) exceeding 122 Hz to the shift register 223. The signals in the range below 80 Hz are subjected to moving averaging with every 37 Hz by the shift register 221, adder circuit 224, and the circuit of the divider 227; those in the range from 80 Hz to 122 Hz with every 61 Hz by the shift register 222, adder circuit 225, and the circuit of the divider 228, and those in the range above 122 Hz with every 85 Hz by the shift register 223, adder circuit 226, and the circuit of the divider 229. When the moving averaging is achieved by means of the moving averaging circuit 22, signal components corresponding to the reflected sounds are eliminated, and a response signal substantially corresponding to the direct sound appears at the output of the moving averaging circuit 22. The smoothed signal is converted into an analog signal by the D/A converter 23, and supplied, for example, to a recorder 24, where it is represented by response (characteristic) curves on a sheet of graph paper.

Measuring the loudspeaker characteristics in the aforesaid manner, the same results may be obtained in the normal room as in an anechoic room. This will more specifically be described with reference to the response and characteristic curves of FIGS. 3 to 8 obtained from actual measurements.

Figure 3:
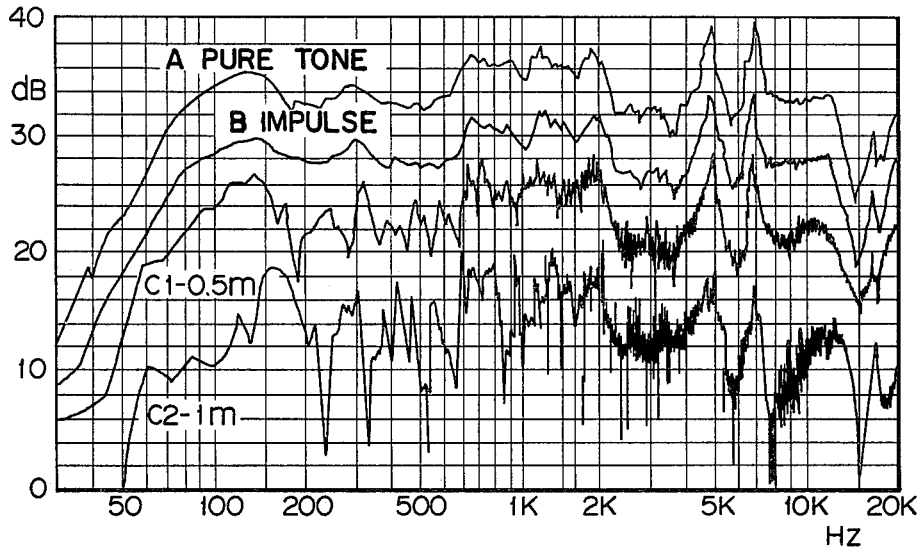
FIGS. 3 to 8 show characteristic curves for illustrating the performance of the loudspeaker characteristics measuring apparatus.

Referring now to the drawing of FIG. 3, response curve A shows a sound pressure frequency characteristic obtained by supplying a pure tone signal to a loudspeaker disposed in an anechoic room. Response curve B shows a frequency response obtained by Fourier-transforming a response signal produced by applying an impulse signal to the loudspeaker disposed in the anechoic room. Curves C1 and C2 show frequency response obtained by supplying the impulse signal to the loudspeaker disposed in a normal room with a microphone at distances of 0.5 m and 1 m from the loudspeaker, respectively. These response curves C1 and C2 are indicative of the effect of the reflected sounds from the wall surfaces. According to this invention, such effect of the reflected sounds may be avoided as follows. The microphone 15 receives a direct sound wave y(t) from the loudspeaker 14 and reflected sounds waves $\alpha i y i(t-\tau i)$ from the wall surfaces. Here $\alpha i$ is a reflection coefficient ($0<\alpha i<1$), and $\tau i$ is a delay time which correspond to a time difference between the direct sound and the reflected sound. Accordingly, an input signal g(t) to the microphone 15 is represented by the following formula (1):

$$g(t) = y(t) + \sum_{i=1}^{n} \alpha i \cdot (t - \tau i). \quad (1)$$

A Fourier-transformed signal G(f) obtained by fast Fourier-transforming such detection signal g(t) by means of the Fourier transform processor 19 is $$G(f) = Y(f) + \sum_{i=0}^{n} \alpha i \cdot \exp(-j2\pi f \tau i). \quad (2)$$

Figure 4:
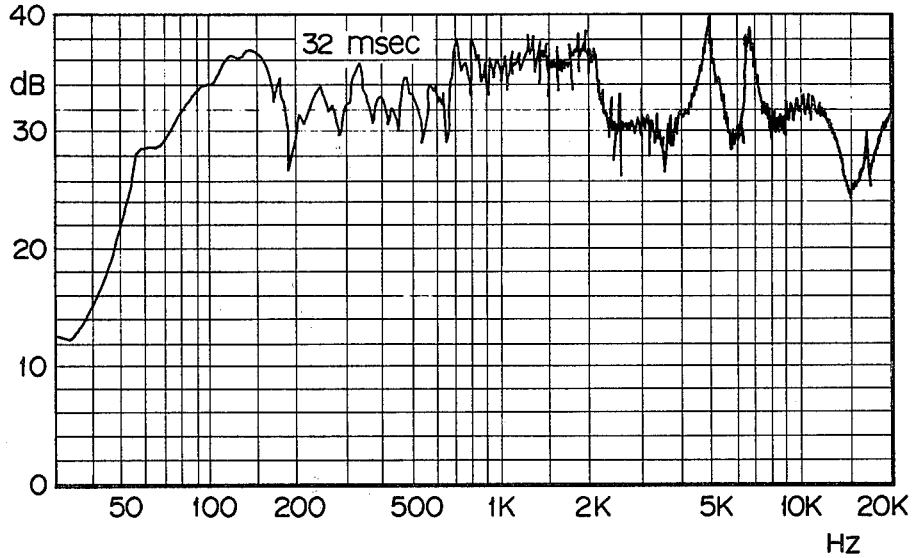

Here $\alpha o=1$ and $\tau o=0$. The Fourier-transformed signal G(f) exhibits a frequency spectrum of the impulse response signal g(t), as shown in FIG. 4. As is clear from FIG. 4, this frequency spectrum signal is subject to the influence of the reflected sounds over a wider frequency range. The signal components corresponding to those reflected sounds are equivalent to the components represented by the term $$\sum_{i=o}^{n} \alpha i \cdot \exp(-j2\pi f \tau i)$$

of eq. (2). Accordingly, the object of this invention may be attained by eliminating that term from eq. (2).

Thus, the signal G(f) is converted into an absolute-value signal by the absolute value circuit 20, and then logarithmically converted by the logarithm circuit 21. The logarithmically converted signal log G(f) may be given as follows:

$$\log |G(f)| = \log |Y(f)| + \frac{1}{2} \log \left[\sum_{i=0}^{n} \sum_{l=0}^{n} \alpha i\, \alpha l \cdot \cos 2\pi f(\tau i - \tau l)\right]. \quad (3)$$

If the reflected wave components are small, eq. (3) may, according to the conditions $\alpha o=0$ and $\tau o=0$, be approximated to $$\log |G(f)| \simeq \log |Y(f)| + \frac{1}{2} \log \left(1 + 2 \sum_{i=1}^{n} \alpha i \cdot \cos 2\pi f \tau i\right). \quad (4)$$

As indicated by eq. (4), the reflected sound components may be separated from the direct sound components. Consequently, it may be understood that the frequency spectrum obtained by the Fourier transformation includes a ripple component given by $\alpha i \cdot \cos 2\pi f \tau i$ where the frequency base is regarded as the time base in FIG. 4.

Figure 5:
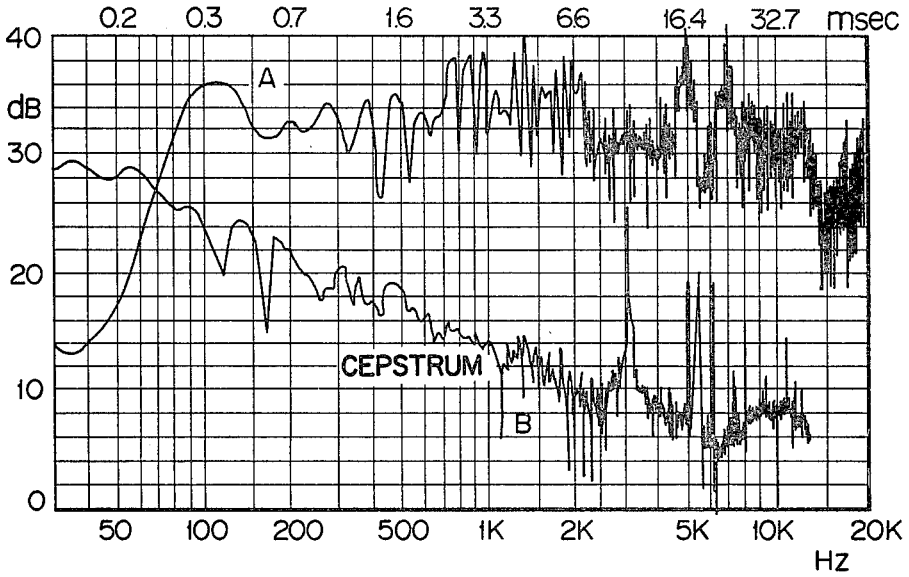

FIG. 5 shows response and characteristic curves obtained by simulating the aforementioned relations by means of a computer. In this drawing, curve A indicates a frequency response obtained by Fourier-transforming the signal resulting from the addition of the reflected wave components $\alpha 1 y(t-\tau 1)$ ($\alpha 1=0.3$, $\tau 1=8$ msec) and $\alpha 2 y(t-\tau 2)$ ($\alpha 2=0.3$, $\tau 2=10$ msec) to the impulse response signal y(t) measured in the anechoic room, that is, $g(t)=y(t)+\alpha 1 y(t-\tau l)+\alpha 2 y(t-\tau 2)$.

Meanwhile, curve B of FIG. 5 shows a cepstrum characteristic obtained by additionally fast-Fourier-transforming the signal, regarding curve A as a time-based waveform. The signal given by the cepstrum characteristic curve B is called "cepstrum" as expressed in term of quefrency (msec). The high-quefrency components of this signal correspond to the reflected sound components in curve A. Therefore, the reflected sound components (ripple) in curve A may be eliminated by filtering the signal of curve B with a low-pass filter in cepstrum domain and attenuating the high-quefrency components. However, the ripple component give by $\alpha i \cdot \cos 2\pi f \tau i$ exhibits large peaks at quefrencies of 8 msec and 10 msec, as indicated by curve B, including peaks attributable to the non-linear processing, i.e. logarithmic processing, also in a range higher than those quefrencies. To eliminate the reflected sound components, it is necessary to filter the waves from a substantially lower range of quefrency. When the filtering is carried out from the lower quefrency than that of the ripple components, the effective components in the low frequency range, may be lost.

Figure 6:
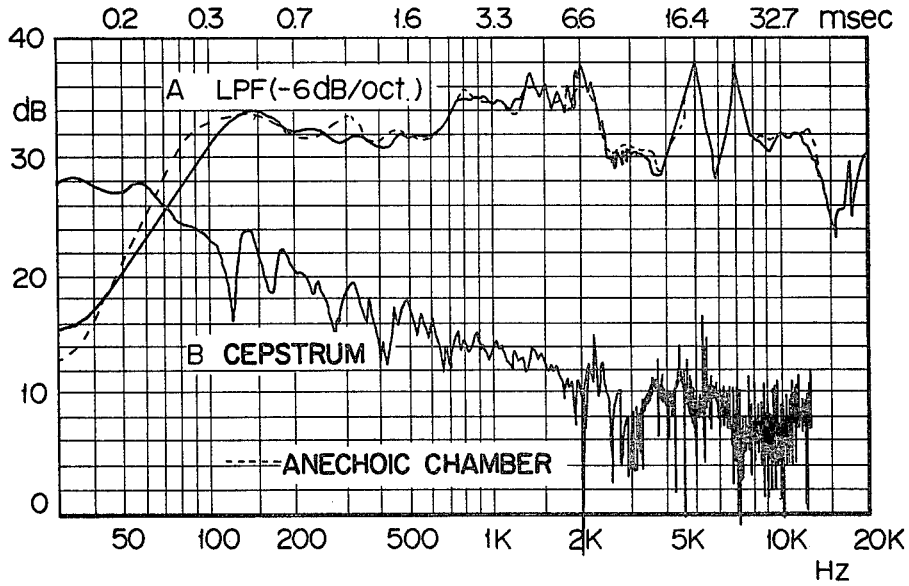
Figure 7:
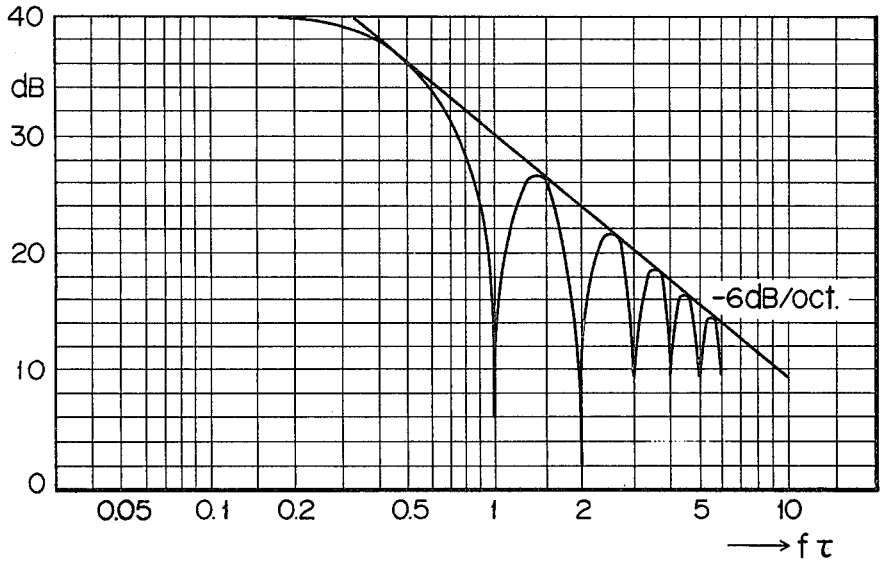
Figure 8:
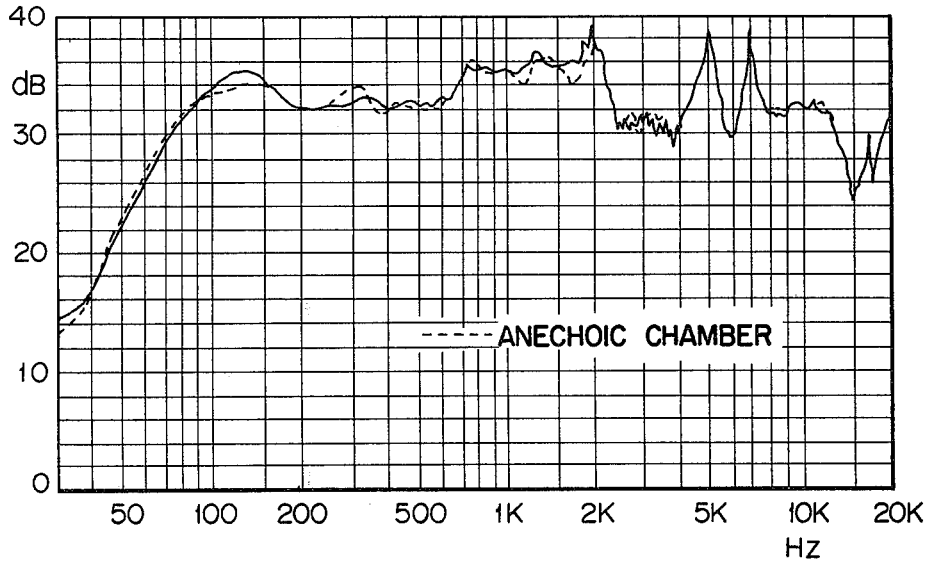

FIG. 6 shows a cepstrum characteristic (curve B) measured in a listening room and a frequency response (curve A) obtained by filtering the cepstrum in a range above 2 msec at −6 dB/oct and then restoring the frequency component from the quefrency component by means of an inverse fast Fourier transform (IFFT) processor. This result shows the information of the loudspeaker characteristics in the lower frequency range is reduced at the same time. In this invention such a defect is eliminated by the moving average with variable averaging points, providing characteristics substantially equal to those of a comb filter of −6 dB/oct shown in FIG. 7. It is of great advantage that the number of averaging points of the moving average in the frequency domain can be varied easily. This means that the equivalent cutoff quefrency of the comb filter in upstream domain can be changed easily. On the other hand, it is well known that it is necessary to use a longer time window for the lower frequency response of a loudspeaker and a shorter time window for the higher frequency range to reduce reflections effectively. Therefore, considering that the comb filter or comb type window in upstream domain plays a similar part of time window with comb type shape in time domain, a change in time window length is equivalent to a change in cutoff quefrency in upstream domain. In FIG. 8 the moving average with variable averaging points in frequency domain is performed with every 37 Hz in the frequency range below 80 Hz; with every 61 Hz in the range from 80 Hz to 122 Hz and with every 85 Hz in the range exceeding 122 Hz. In the frequency range below 80 Hz, the response signal is averaged sequentially in units of 12.2 Hz three units (first, second and third frequency units) in succession, and further the resulting three average values are averaged to obtain one average value. This value corresponds to 12.2 Hz$\times$3$\approx$37 Hz. Next, the respective average values of the second, third and fourth frequency units are averaged. Thus, the average values for respective 37 Hz—frequency ranges are obtained with respect to the frequency range below 80 Hz. In the frequency range of 80 Hz to 122 Hz, the response signal is similarly averaged sequentially in units of 12.2 Hz five units in succession. That is, as in the preceding case, the moving average value which corresponds to 12.2 Hz$\times$5=61 Hz is determined. With regard to the frequency range of 122 Hz or more, the moving average value which corresponds to 12.2 Hz$\times$7$\approx$85 Hz is determined similarly. When the signal is subjected to the moving averaging by such variable moving averaging points, the resultant characteristic approaches the response curve (given by a broken line in FIG. 8) as obtained by the measurement in the anechoic room. That is, if measuring in the normal room, there may be obtained substantially the same frequency response as that resulting from the measurement in the anechoic room.

When the object of this invention may be attained by attenuating the reflected wave component ($\cos 2\pi f \tau i$) and components n times as many as such component, as stated above, a relatively higher cepstrum may be obtained for those components as compared with the direct wave component Y(f0) by placing the subject loudspeaker substantially in the center of the room. Moreover, the operating point of the moving averaging circuit need be set only once if the loudspeaker is fixed in the center of the same room.

Figure 9:
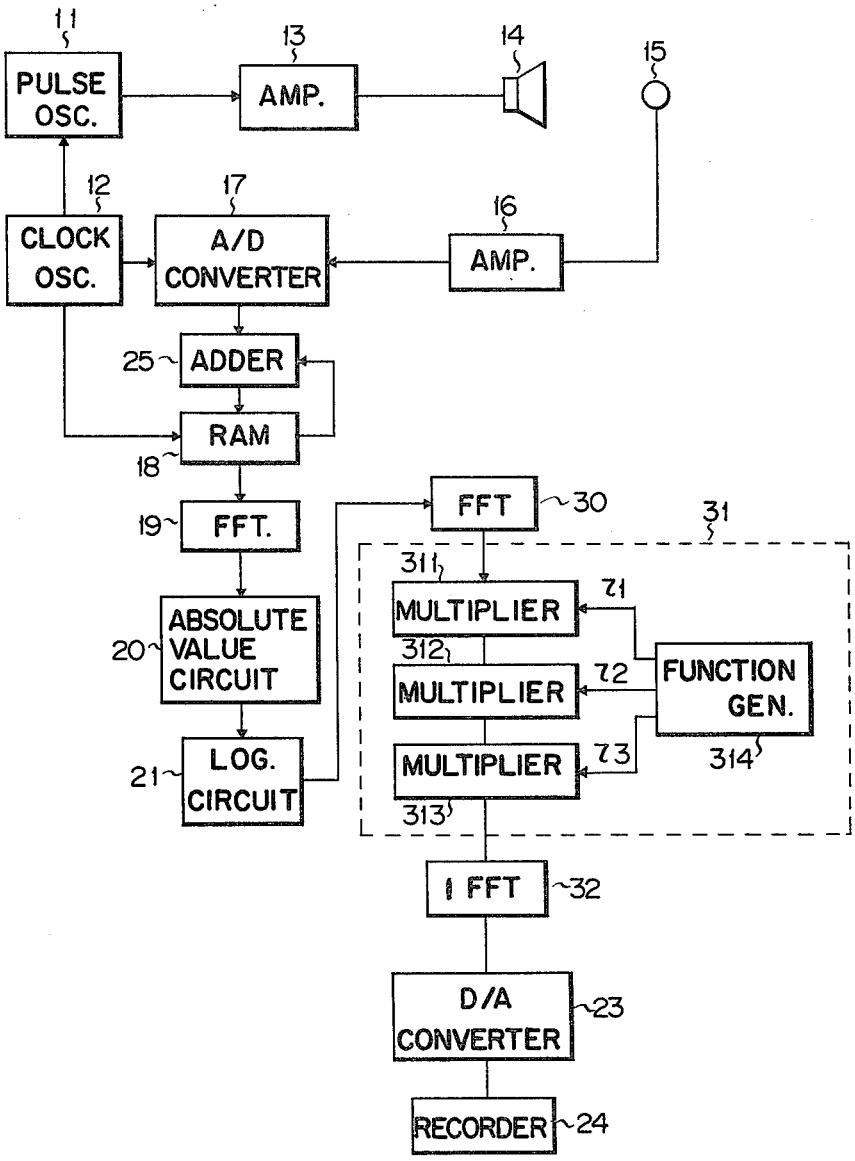
FIG. 9 is a block diagram of a loudspeaker characteristics measuring apparatus according to another embodiment of the invention which includes a comb filter circuit.

Referring now to FIG. 9, there will be described another embodiment of this invention. In this embodiment the same parts or members of the preceding embodiment are designated by like reference numerals, and repeated description of such parts is avoided. In FIG. 9 the output terminal of the logarithm circuit 21 as shown in FIG. 1 is coupled to a second fast Fourier transform processor 30, the output terminal of which is coupled to a comb filter circuit 31. The comb filter circuit 31 is composed of 3-stage multipliers 311, 312 and 313 and a function generator 314 to supply these multipliers, respectively, with function signals $\tau 1$, $\tau 2$ and $\tau 3$ given by $4\sqrt{\sin \pi I\tau / \pi I\tau}$. The output terminal of the comb filter circuit 31 is coupled to the recorder 24 through an inverse fast Fourier transform processor 32 and the D/A converter 23.

Figure 10:
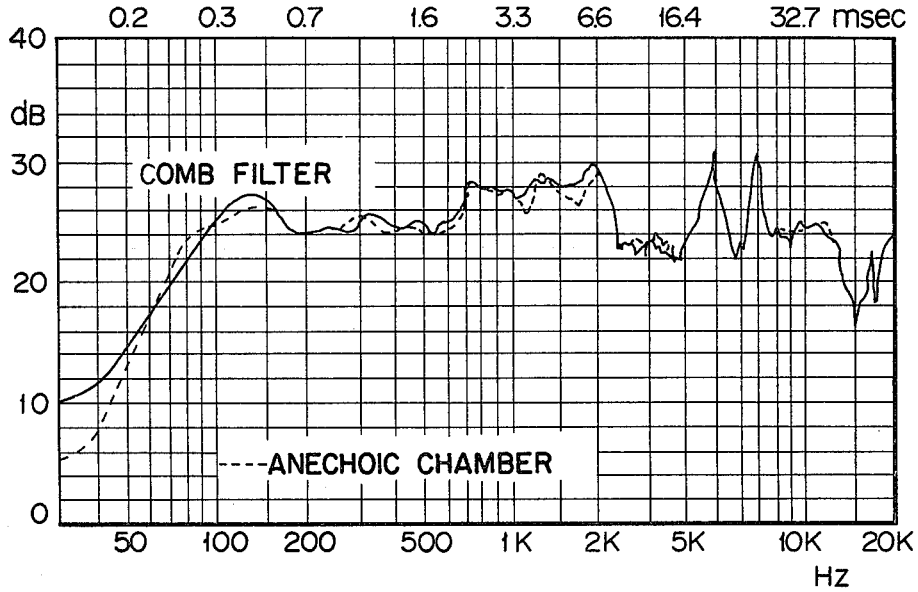
FIG. 10 shows a measurement characteristic curve for the loudspeaker characteristics measuring apparatus of FIG. 9.
Figure 11:
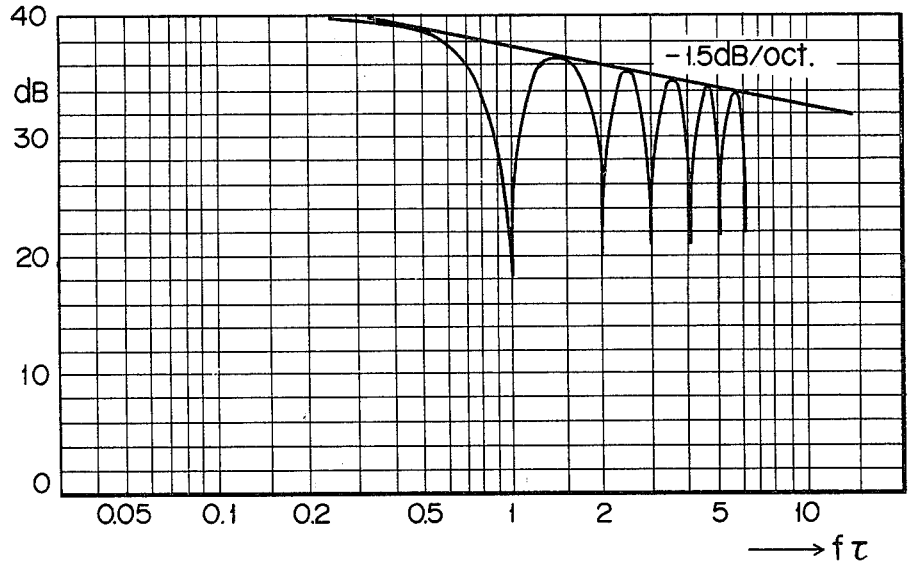
FIG. 11 shows characteristic curves of the comb filter circuit.

In the above-mentioned embodiment of FIG. 9, the comb filter circuit 31 is so constructed as to have the respective initial zero points for reflected signal components corresponding to the reflected sounds from the wall surfaces in at least three directions. The initial zero points may be set by means of the function signals $\tau 1$, $\tau 2$ and $\tau 3$ generated by the function generator 314 in accordance with the time differences between the direct sound and the reflected sounds. Where the reflected sound components have their respective initial peaks at quefrencies of 6.9 msec, 12 msec and 17 msec, for example, there may be obtained a characteristic curve (solid line) substantially identical (within 1 dB in a range above 50 Hz) with a characteristic curve (broken line) obtained by the measurement in the anechoic room, as shown in FIG. 10 with the comb filter circuit so set as to allow the initial zero points to correspond to those quefrencies. The comb filter circuit used may have a relatively gentle slope characteristic (−1.5 dB/oct), so that the effective components in the low frequency range of the loudspeaker will never be lost. Also in the case of this embodiment, the operating point of the comb filter circuit may be fixed by disposing the subject loudspeaker substantially in the center of the same room. Further, the object of this invention may be attained by adjusting the zero points to delay times equivalent to the time differences between the direct sound and the reflected sounds from the wall surfaces. That is, the initial zero points of each stage of comb filter circuit are related to the dimensions of the room. In an experimental study there were determined, for the frequency components in a range above 50 Hz, characteristics equivalent to those obtained from the measurement in the anechoic room.

According to this invention, as described above, characteristics of a loudspeaker may be measured under good conditions without requiring an anechoic room, thereby simplifying and decreasing the expense of the measuring equipment. Thus, measurements of the loudspeaker characteristics may satisfactorily be made without receiving any bad influence from reflected sounds, not limited by the measuring circumstances—even in a laboratory, for example.

What we claim is:

1. A method for measuring characteristics of a loudspeaker, comprising steps of driving the loudspeaker with an impulse signal to produce a loudspeaker impulse response sound; converting a loudspeaker direct impulse response sound and reflected loudspeaker impulse sounds from a plurality of positions into an impulse response signal; converting the impulse response signal into a digital response signal; performing a Fourier-transform of the digital response signal; converting the Fourier-transformed response signal into a signal having an absolute value; converting the Fourier-transformed absolute value response signal into a logarithmic response signal; filtering the logarithmic response signal to eliminate the signal components corresponding to the reflected sound signal; converting the filtered logarithmic response signal into an analog response signal; and outputting the analog response signal.

2. A method according to claim 1 wherein said filtering step is carried out by a Fourier-transform of the logarithmic response signal, by at least three stages of comb filter circuit having respective null points corresponding to time differences between a loudspeaker direct sound signal and loudspeaker reflected sound signals in cepstrum domain, and by an inverse Fourier-transform of the filtered response signal.

3. A method according to claim 1 wherein said filtering step includes the step of calculating the moving average of the response signal with variable averaging points, in frequency domain of the response signal.

4. An apparatus for measuring characteristics of a loudspeaker, comprising; a pulse generator for generating an impulse signal which drives a loudspeaker to obtain an impulse response sound therefrom; means for converting the direct impulse response sound together with the reflected sounds from a plurality of positions into a digital response signal; a Fourier-transformer for Fourier-transforming the digital response signal; means for converting the Fourier-transformed response signal into a response signal having an absolute value; a logarithmic circuit for transforming the absolute value signal into a logarithmic response signal; means for filtering the logarithmic response signal to eliminate therefrom reflected signal components corresponding to the reflected sounds; a D/A converter for converting the filtered response signal into an analog response signal; and an output device for outputting the analog response signal.

5. An apparatus according to claim 4, wherein said filtering means comprises a Fourier-transformer for Fourier-transforming the logarithmic response signal, a comb filter circuit including a plurality of stages having null points corresponding to time differences between a direct sound signal and plural reflected sound signal in cepstrum domain, and an inverse Fourier-transformer for inverse Fourier-transforming the filtered response signal.

6. An apparatus according to claim 4 wherein said filtering means comprises circuit means for calculating the moving average of the response signal with variable averaging points, in frequency domain of the response signal.

* * * * *